US009482032B2

(12) United States Patent
Bedoian et al.

(10) Patent No.: US 9,482,032 B2
(45) Date of Patent: Nov. 1, 2016

(54) SYSTEM FOR CHANGING A LOCKING STATE

(76) Inventors: Heike Bedoian, Siegen (DE); Samuel Bedoian, Siegen (DE); Alexander Zurkan, Niederfischbach (DE)

( * ) Notice: Subject to any disclaimer, the term of this patent is extended or adjusted under 35 U.S.C. 154(b) by 234 days.

(21) Appl. No.: 14/004,782

(22) PCT Filed: Mar. 2, 2012

(86) PCT No.: PCT/EP2012/000929

§ 371 (c)(1),
(2), (4) Date: Sep. 12, 2013

(87) PCT Pub. No.: WO2012/123073

PCT Pub. Date: Sep. 20, 2012

(65) Prior Publication Data

US 2014/0001779 A1 Jan. 2, 2014

(30) Foreign Application Priority Data

Mar. 12, 2011 (DE) ..... 10 2011 013 730

(51) Int. Cl.
*E05B 3/06* (2006.01)
*E05B 47/00* (2006.01)
(Continued)

(52) U.S. Cl.
CPC ..... *E05B 47/00* (2013.01); *E05B 1/003* (2013.01); *E05B 17/22* (2013.01); *E05B 45/06* (2013.01);
(Continued)

(58) Field of Classification Search
CPC ..... Y10T 292/57; Y10T 292/0917; Y10T 292/102; Y10T 70/5097; E05B 17/22; E05B 1/003; E05B 2047/0067; E05B 17/0083; E05B 2047/0097; E05B 41/00; E05B 2045/0615; E05C 9/066; E05C 1/14
USPC ..... 292/336.3
See application file for complete search history.

(56) References Cited

U.S. PATENT DOCUMENTS

| | | | | |
|---|---|---|---|---|
| 7,770,943 | B2 * | 8/2010 | Kaiser | E05B 17/20 292/144 |
| 2007/0170729 | A1 * | 7/2007 | Kaiser | E05B 47/0012 292/251.5 |
| 2009/0139052 | A1 | 6/2009 | Boenisch | |

FOREIGN PATENT DOCUMENTS

| | | | |
|---|---|---|---|
| DE | 10 2004 018064 | A1 | 10/2005 |
| DE | 20 2005 006 795 | U1 | 12/2006 |

(Continued)

OTHER PUBLICATIONS

International Search Report (in German with English translation) for PCT/EP2012/000929, mailed May 25, 2012; ISA/EP.

*Primary Examiner* — Mark Williams
(74) *Attorney, Agent, or Firm* — Harness, Dickey & Pierce, P.L.C.

(57) ABSTRACT

The invention relates to a system for changing a locking state of a window and/or a door, comprising at least one handle housing that can be connected in a rotationally fixed manner to the window and/or the door and a handle that is rotatably mounted relative to the handle housing. The invention further comprises at least one electronic evaluation circuit for detecting the position of the handle, wherein the evaluation circuit is provided with at least one primed circuit board arranged, at least in part, inside the handle housing and/or the handle, and accommodating a first sensor. The handle is connected in a pivotably secure manner to at least one connecting device, which extends through the handle housing, by way of which the locking state of the window and/or the door can be changed, wherein the primed circuit board is connected to the connecting device and/or the handle in a pivotably secure manner.

29 Claims, 8 Drawing Sheets

(51) Int. Cl.

| | |
|---|---|
| ***E05B 1/00*** | (2006.01) |
| ***E05B 17/22*** | (2006.01) |
| ***E05B 45/06*** | (2006.01) |
| *E05B 15/00* | (2006.01) |
| *E05B 17/00* | (2006.01) |
| *E05B 41/00* | (2006.01) |

(52) U.S. Cl.

CPC ..... *E05B 1/0084* (2013.01); *E05B 15/0053* (2013.01); *E05B 17/0083* (2013.01); *E05B 17/0087* (2013.01); *E05B 41/00* (2013.01); *E05B 2047/0058* (2013.01); *E05B 2047/0067* (2013.01); *E05B 2047/0068* (2013.01); *E05B 2047/0094* (2013.01); *E05B 2047/0097* (2013.01); *Y10T 292/57* (2015.04)

(56) References Cited

FOREIGN PATENT DOCUMENTS

| | | | |
|---|---|---|---|
| DE | 10 2005 031106 | A1 | 1/2007 |
| DE | 10 2010 018780 | B3 | 3/2011 |
| DE | 102011013730 | A1 | 9/2012 |
| EP | 1 785 962 | A2 | 5/2007 |
| EP | 1 903 165 | A2 | 3/2008 |
| EP | 02686509 | A1 | 1/2014 |
| WO | WO-2007/107529 | A1 | 9/2007 |

* cited by examiner

SYSTEM FOR CHANGING A LOCKING STATE

The present invention relates to a system for changing a locking state of a window and/or of a door, comprising at least one handle housing that can be connected in a rotationally secure manner to a window and/or door, and a handle hinge-mounted relative to the handle housing, at least one electronic evaluation circuit for detecting the position of the handle, the evaluation circuit having at least one printed circuit board arranged at least partially within the handle housing and/or the handle and having a printed circuit board bearing a first sensor, and the handle being connected in a rotationally secure manner to at least one connecting device extending through the handle housing by means of which the locking state of the window/the door can be changed, and a window or a door comprising such a system, as well as a method for detecting a position of such a system.

Such a system is known, for example, from DE 20 2005 006 796 U1, which discloses a monitoring system for windows and doors. This monitoring system for securing windows and doors has a swivel-mounted handle that is held on a handle fitting and can be connected via a multi-point socket pin to closure devices of the doors or windows. A printed circuit board mounted in a substantially immoveable manner is arranged within a housing through which the multi-point socket pin extends. To enable the determination of the position of the handle, it is proposed that a switching sleeve is mounted on the multi-point socket pin that can interact with the microswitches embodied as buttons. In order to also enable monitoring of whether the door or the window is in a closed or open position, the monitoring system further comprises a main part supported in a sash or a door leaf and an additional part arranged adjacently in the stationary frame. The second sensor device formed in this way next to the sensor device for determining the position of the handle has magnets and appropriately corresponding reed contact switches in order to determine the different positions of the door or window. Through appropriate analyses of the data of the first and second sensor device, it is recognized whether the door or window is in an open or closed position and whether the handle is in a locked or in an unlocked position. In different constellations, for example if the window in in a closed position without the handle assuming a locked position, or if the handle is in a locking state and a movement of the window from the closed to the open position occurs, particularly in the event of a burglary, an alarm is triggered.

However, this monitoring system has the drawback that a plurality of sensors has to be used in order to enable both the monitoring of the position of the handle and of the window or door. Furthermore, when the window or door with the monitoring system is retrofitted, besides the changing of the handle and handle sleeve, additional manipulations must also be performed on the window, particularly the positioning of the second sensor device.

Moreover, DE 10 2005 031 106 A1 discloses a window handle with motion sensor, wireless data transmission and autarchic energy supply. Proposed here is a window handle with standard connection dimensions that enables the microsystemic arrangement of a motion sensor, a microprocessor, a transceiver device, an energy store and a system for renewable power generation. The window handle, which is described as a smart handle, is intended to make it possible to give a system information about an angle of opening or inclination and the locking state of a window. This window handle has the drawback that, due to the integration of the motion sensor into the window handle, adaptation to various environmental conditions is only possible by changing out the entire window handle.

It is therefore the object of the invention to further develop the generic device known from the prior art such that the drawbacks thereof are overcome, particularly by providing a system that has a simple construction by means of which both the monitoring of a position of a handle and the monitoring of the position of the window or door in a structurally simple manner while simultaneously enabling easy adaptability to various environmental conditions, particularly the type of window or door in which the system is to be used, as well as the parameters to be monitored and the way in which the result of the analysis of the data is forwarded to the surroundings. Moreover, a method, improved in comparison to the prior art, for detecting a position of a device for changing a locking state of a window and/or door is to be provided.

This object is achieved according to the invention by connecting the printed circuit board in a rotationally secure manner to the connecting device and/or the handle.

In particular, it is proposed that the handle housing comprise at least one handle sleeve and/or be formed by the handle sleeve, the handle sleeve being particularly attachable to the window and/or door, particularly a frame of the window and/or door, particularly by means of at least one first fastening device.

A system according to the invention can also be characterized in that the connecting device comprises at least one multi-point socket pin, particularly square socket pin, and/or the connecting device can be operatively connected, particularly by means of a rotationally secure mechanical connection, to at least one locking device of the window and/or door by means of which the position of at least one fitting of the window and/or door can be changed.

Moreover, a system according to the invention can be characterized by at least one latching device, particularly arranged in the handle housing and/or adjacent to the printed circuit board and/or enclosed at least in part by the handle housing and/or embodied, particularly in a single piece, preferably by means of injection molding, with the handle housing and/or having locking catches and/or a spring-loaded ball mechanism, by means of which latching device the handle and/or connecting device can engage in at least one, preferably a plurality, of handle positions, preferably in at least one locking position in which the window and/or door, particularly the locking device, is located in a locked position in which, particularly, a swiveling, traversing and/or tilting movement of the window and/or door is prevented, preferably when the window and/or door is located in its or their closed position, in at least one unlocking position in which the window and/or door, particularly the locking device, is in an unlocked position in which, in particular, a swiveling and/or traversing movement of the window and/or door is enabled, preferably when the window and/or door is located in its or their open position or a closed position, and/or at least in a partial unlocking position in which the window and/or door, particularly the locking device, is located in a partially unlocked position in which, particularly, a swiveling and/or traversing movement of the window and/or door is prevented and/or a tilting movement is enabled, preferably when the window and/or door is located in its or their closed position.

Furthermore, at least one fixing device proposed is with the invention that is particularly enclosed by the latching device at least in part and connectable in a rotationally secure manner to the connecting device and/or the handle, particularly by plugging onto or into it, and/or positionable on the printed circuit board in a rotationally secure manner, particularly by means of plugging on and/or locking.

It is preferred that the printed circuit board have a rotationally symmetrical, particularly circular, circumferential shape and/or at least one receptacle, particularly comprising at least one depression, one recess and/or one hollow be provided in the printed circuit board, particularly on the outer periphery thereof, in the vicinity of at least one opening to the receptacle of the connecting device and/or the fixing device and/or in the surface of the printed circuit board, it being possible to support in the receptacle at least one complementary element arranged on a surface of the connecting device and/or the fixing device, particularly to establish a predetermined relative position between the printed circuit board on the one hand and the connecting device, the handle and/or the fixing device on the other, or the printed circuit board comprises the complementary element and the connecting device, the handle and/or the fixing device comprise(s) the receptacle.

Moreover, the invention proposes that the first sensor comprise at least one sensing device enabling autarchically the determination of its own position and/or its spatial orientation, and/or at least one sensing element of the first sensor and/or of the sensing device is positioned eccentrically on the printed circuit board relative to an axis of rotation of the printed circuit board, the connecting device, the handle and/or the fixing device.

In the abovementioned embodiment, it is especially preferred that the sensing device enable the determination of the position and/or orientation on the basis of acceleration data, velocity data, movement data, data on the Earth's magnetic field, GPS data and/or (gyro)compass data, particularly detected by means of the sensing element, particularly that the sensing device comprise at least one 3D sensor, preferably a 3D-MEMS acceleration sensor.

In the two abovementioned alternatives, it is particularly proposed that the sensing device enable the determination of the handle position, the open position, the closed position and/or the tilting position of the window and/or door, of an at least partial destruction of the structure of the window and/or door and/or of the position of the printed circuit board, the fixing device, the connecting device and/or the handle.

A system according to the invention can also be characterized by at least one component that can be connected electrically, electronically, by cable and/or wirelessly to the printed circuit board and/or arranged on the printed circuit board, particularly comprising at least one power source, such as a battery, an accumulator, a thermoelectrical element and/or a mechanoelectrical element for generating electrical power from mechanical kinetic energy and/or thermal energy, particularly from a temperature difference, preferably between a side of the window and/or door facing toward the system and a side facing away from the system, and/or a solar element, an energy store, an optical and/or acoustical output device, particularly comprising at least one loudspeaker, one siren, one display device and/or at least one illuminating device, at least one input device, such as a switch, a keyboard, a microphone, a photographic and/or video camera and/or a touchscreen, a reading device, a data communications device, at least one additionally printed circuit board, preferably that can be stacked on the printed circuit board, a valve assembly, particularly an underpressure valve assembly, and/or a functional unit spatially separated form the system and connected to the system by cable, wirelessly and/or by radio, particularly via the data communications device, it being preferably possible to arrange the component in the handle, the connecting device, the fixing device, the latching device and/or the handle housing, the additional printed circuit board comprising the data communications device, the data communications device operating on free ISM frequency bands, particularly 433 MHz, 886 MHz and/or 2.4 GHz, and/or by means of KNX, WLAN, 433 MHz, 886 MHz, z-wave and/or zigbee radio standards and/or the second printed circuit board is mounted in a stationary manner relative to the handle housing, the handle and/or the connecting device.

In the abovementioned alternative, it is preferred that a signal be able to be outputted by means of the output device when the charge of the energy store device undershoots a predetermined threshold value and/or a hole in the handle housing and/or handle preferably extending at least partially around the opening in the handle housing for the connecting device and/or arranged adjacent to the printed circuit board can be illuminated by means of an optical output device preferably arranged on the printed circuit board.

Moreover, in the two abovementioned embodiments, it is preferred that an output signal intensity of the output device can be adapted depending on other environmental parameters, particularly a lighting situation or a noise level detected by means of a twilight sensor.

It is also proposed that the input device and the output device be embodied at least partially as one, particularly that a loudspeaker, preferably a piezoelectric loudspeaker be embodied such that it can be used as a microphone, and/or that the input device comprise the first sensor at least in part, with a one-time or repeated tapping, particularly of the handle, the handle housing and/or the connecting device preferably being identifiable by means of the first sensor.

Moreover, it is proposed with the invention is at least one, preferably electrical, wired, wireless and/or radio-connected connection means, such as at least one plug contact device and/or loop contact device, by means of which the printed circuit board can be connected to at least one other element, particularly the component, the system, the functional unit and/or the other printed circuit board, with the connection means being enclosed at least partially by the connecting device and/or fixing device, and/or the printed circuit board can be connected automatically to the other element by means of the connection means by plugging onto and/or connecting to the connecting device and/or fixing device.

It is especially preferred here for the printed circuit board, the element, the component, the functional unit and/or the other printed circuit board to comprise at least one second sensor, preferably for detecting additional environmental conditions, such as a temperature, an air humidity, a light intensity, a twilight level, the approach of a person, a concentration of at least one gas, particularly carbon monoxide, a smoke concentration, a one-time and/or multiple tapping of the handle, of the handle housing and/or of the connecting device, an intactness of the structure of the window and/or door, and/or a glass breakage, the second sensor being preferably enclosed by the input device at least in part.

It is also proposed with the invention that the system be connectable to at least one additional device preferably embodied separately from the system, preferably by means of the data communications device, particularly by cable, wirelessly and/or radio connection, such as at least one alarm center, a house automation component, such as a house automation center, an actuator, such as a rolling actuator, a roller blind motor, a sun visor actuator, a belt winder, interior and/or exterior lighting, a heating system, particularly interior space heating system, a device for darkening at least one glass pane comprised by the door or window, a drive device for changing the position of the handle, the window and/or door and/or a ventilation system.

A system according to the invention can also be characterized by at least one calibration device by means of which the data of the first sensor and/or of the second sensor can be calibrated, particularly the data of the first sensor can be allocated to the individual positions of the fixing device, the connecting device and/or the handle.

Finally, it is proposed for the system according to the invention that a plurality of first sensors and/or second sensors be provided, particularly which are used and/or analyzed redundantly and/or operated and/or analyzed in parallel to increase sensing precision and/or to enable automatic calibration, changing of an operating mode and/or detection of pulses.

The invention further provides for a window or a door comprising a system according to any one of the preceding claims, particularly in the form of a tilting window that can be swiveled both about a horizontal and at least one vertical axis, a window that can be swiveled about only one vertical axis or one horizontal axis, at least one sliding window, a pan-tilt window, a sliding door, a lift-and-slide door, a tilting-sliding door and/or a tilting door.

The object relating to the method is achieved by a method for detecting a position of a system for changing a locking state of a window and/or door, particularly of a system according to the invention, and of a position of the window and/or door, the locking state and the position being detected by means of at least one first sensor. Preferably, at least one locking state and/or position is or are allocated by means of a calibration device and/or an initialization device to the data detected by means of the sensor.

It is especially preferred here that an at least partial destruction of the structure of the window and/or door be detected by means of the first sensor, a distinction being made, particularly by means of the first sensor, preferably by means of data provided by the first sensor and/or pulses acting on the first sensor, between permitted events and/or events not requiring alarm generation, such as a collision of an object not impacting the structure, for example for the purpose of knocking, and events that are not permitted and/or require alarm generation, such as glass breakage.

In the two abovementioned embodiments, it is particularly proposed that an initialization/calibration of the system by means of the calibration device and/or the initialization device and/or the changing of the operating state of the system be started based on data of the first sensor, based on data of at least one second sensor, based on at least one input by means of an input device and/or the generation of at least one pulse acting on the first sensor and/or second sensor, particularly of pulses that act on the first sensor and/or second sensor in a predetermined sequence.

It is also proposed with the invention that, particularly in order to generate the at least one pulse acting on the sensor, particularly of the predetermined sequence of pulses, a handle, a connecting device, a fixing device and/or a printed circuit board, on which the first sensor is arranged, of the system and/or the window and/or door is moved or transferred and/or at least one pulse acting at least on the first sensor and/or the second sensor is generated by means of at least one latching device, preferably by means of the first sensor and/or second sensor, particularly for determining the position of the system, preferably of the handle, and/or for determining a locking position, an unlocking position and/or a partial unlocking position, a locking of the system by means of the latching device, by means of which particularly the handle and/or the connecting device can engage in at least one, preferably a plurality of handle positions, and/or a one-time or multiple tapping of a component of the system is detected.

It is especially preferred that, in order to execute or terminate the calibration and/or initialization, the system and/or the window and/or door is or are moved into at least one, preferably a plurality of positions.

It is also proposed with the invention that, by means of the first sensor, a spatial position and/or orientation of the printed circuit board connected particularly in a handle housing and/or in a rotationally secure manner to the handle, to a fixing device and/or to a connecting device, is determined, and/or a force effect on the system and/or the window and/or door is determined.

It is especially preferred that, by means of the first sensor, a swiveling, sliding and/or tilting movement of the window and/or door be detected preferably when the window and/or door is located in a closed position and/or a tilted position.

The method according to the invention can also be characterized in that, by means of the first sensor, its own spatial position and/or orientation is detected in an autarchic manner, preferably by means of a sensing device based on acceleration data, velocity data, movement data, data on the Earth's magnetic field, GPS data and/or (gyro)compass data.

Moreover, it is proposed with the invention that, by means of at least one output device, at least one alarm signal is outputted when a lifting, swiveling, sliding and/or tilting movement is detected, when the system is in a locking position, when a swiveling and/or sliding movement is detected, when the system is in a partial unlocking position, when a movement that is characteristic of an at least partial destruction of the structure of the window and/or door is detected by means of the first sensor, when the system is in a locking position and the system is in an inside opening prevention mode, particularly when the door and/or window is simultaneously closed, and the system is moved out of the locking position.

A method according to the invention can be characterized in that, particularly additionally or exclusively based on data of at least one second sensor, at least one additional environmental condition, such as a temperature, an air humidity, a light intensity, a twilight level, the approach of a person, a concentration of at least one gas, particularly carbon monoxide, a smoke concentration, an intactness of the structure of the window and/or door, a charge state of an energy store device and/or glass breakage is detected by means of the first sensor and/or second sensor, at least one special alarm is triggered, area monitoring, particularly by means of a photographic and/or video camera, is activated, and/or an additional functional component, such as an underpressure valve, a ventilation device and/or a drive device, an interior and/or exterior lighting is controlled, particularly in the event of a movement of the handle in a child safety mode, an incidence of light that exceeds a nominal light incidence value, a temperature that over- and/or undershoots at least one nominal temperature value, air humidity that over- and/or undershoots at least one nominal air humidity value, a charge state that over- and/or undershoots a threshold value, the proximity of a person that is less than the minimum distance, a gas concentration that hat over- and/or undershoots a gas concentration threshold value, and/or a smoke concentration that over- and/or undershoots a smoke threshold value.

Finally, it is also proposed with the invention that the system be connected, preferably by means of a data communications device, to at least one other device that is particularly embodied separately from the system, such as at least one alarm center, a house automation component, a house automation center, an actuator, a rolling actuator, a roller blind motor, a sun visor actuator, an additional, preferably a plurality of device(s) for changing the locking state of a door or a window, particularly system(s) according to the invention, and/or a belt winder.

The invention is therefore based on the surprising insight that, through the arrangement of a printed circuit board in the area of a connecting device that is connected, for one, to a handle of the system in a rotationally secure manner and, for another, the connection to a locking device within the window and/or door is made possible, the printed circuit board also being connected in a rotationally secure manner to the connecting device or being arranged on it and/or the at least partial arrangement of the printed circuit board in the handle, for example an extension of the printed circuit board into the handle, is made possible in a structurally simple manner, that both the position of a handle and a position of a window and/or door can be detected simultaneously. At the same time, this arrangement of the printed circuit board enables a modular construction of the system, particularly in order to enable functional or systematic expansion of the system.

Here, "printed circuit board" is understood as particularly being a circuit board on which are arranged electronic or microelectronic components, particularly switching elements or integrated components, and conductive paths, particularly for the electrical connection of the components. The components comprise, for example, at least one store, one analysis device in the form, for example, of a microprocessor and/or at least one first sensor.

Here, the first sensor particularly comprises an autarchic sensor, an autarchic sensor being understood in terms of the invention as a sensing device that is embodied in a single piece such that no additional counter-element is required in order to enable the recognition of a position, like in the case of a reed contact, for example, in whose vicinity a magnet must be arranged that can be moved relative to the contact, or in the case of microcircuits in which elements triggering the microcircuit must be provided outside of the element to be moved. Suitable autarchic sensors are all types of 3D sensors, i.e., sensors that enable the determination of the spatial position or orientation of the sensor itself or of the unit on which the sensor is arranged. Here, the sensor can be based on various measurement principles, for example the analysis of the Earth's magnetic field lines, the detection of satellite positioning data, or the detection of movement parameters such as velocity or acceleration. One example of a suitable sensor is the 3D sensor by the Honeywell Company of type HMC 5843 or by the Analog Devices Company of type ADXL345.

The use of a 3D MEMS sensor, particularly acceleration sensor, is especially preferred. Microelectromechanical systems make it possible to implement sensors as integrated components that were previously constructed of several components.

Surface micromechanical principles, for example, are used to implement an acceleration sensor. For this purpose, a freely moveable comb structure can be embodied on one wafer side of a substrate which is then designed to be moveable for detachment from the substrate. The moveable and fixed comb structures then form a capacitor configuration the capacity of which changes depending on the acceleration values acting on it, thus enabling the detection of the acceleration signal from a qualitative point of view. By designing the structure in the three spatial directions, detection of acceleration is enabled in the three spatial directions.

By linking the quantitative acceleration data to time information for the acceleration signals, latching movements or signals of the latching device, which is explained below, can thus be detected and the position of the handle film can be deduced and the spatial position of the window and/or door determined, and burglary attempts can also be detected. The detection of the burglary attempt occurs early on, particularly upon lifting of the window and/or door. If the window and/or door is in the locked state, for example, and acceleration is detected that occurs parallel to the plane of a frame of the window and/or door, it can be recognized without a doubt that an attempt is being made to pry the window open. A 3D acceleration sensor also makes it possible to detect glass breakage because the force acting on the window and/or door results in acceleration of the handles or of the handle housing, and these characteristic acceleration values enable the detection of glass breakage.

This determination of a position of the handle film with a single 3D (acceleration censor) can also be implemented independently of the arrangement of the printed circuit board, particularly on the connecting device.

Through the eccentric positioning of the first sensor on the printed circuit board or board, an autarchically operating sensor is rendered capable of clearly determining its spatial position and orientation and, simultaneously, determining the spatial position of the window and/or door. Accordingly, it is particularly possible with the sensor to detect whether the handle is in a locked position, an unlocked position or a partially locked position. Here, a locked position is understood particularly as a position in which a window that is in a closed position is locked with the door or window frame such that it is not possible to open the door or window without destroying or manipulating the structure of the window or door.

An unlocked position is particularly understood as meaning that the window or door can be moved from the closed position into the open position or vice versa, whereas a partially locked position is understood as meaning that the locking device, particularly fittings of the window or door, engage into a frame or surrounding structure in such a way that only a partial movement, for example the tilting of the window or door, is enabled.

It is especially preferred in the invention if the printed circuit board can be connected to the connecting device in a rotationally secure manner, for example through clipping onto the fixing device, via a fixing device, for example in the form of a sleeve made of a plastic material. In this way, the insulation of the printed circuit board from the connecting device, which consists mostly of electrically conductive material, particularly metal, for example a multi-point socket pin, can be enabled. At the same time, the fixing device can also serve as part of a latching device. Here, the latching device makes it possible for the handle or the connecting device to be locked in predetermined positions relative to the handle housing, which is particularly fixed relative to the window or the door structure. This preferably leads to locking into the previously described three locked, unlocked and partially locked positions.

This integration of the fixing device into the latching device also offers the advantage that the printed circuit board, and hence the first sensor, is arranged close to this latching device, and it is particularly made possible for the first sensor, particularly through detection of movement parameters such as velocity or a change in movement, of the handle or the connecting device can be detected particularly before or during engagement, so that the position of the handle can be clearly determined once these locking pulses are detected. Preferably, an additional part of the latching device is embodied by the handle housing itself, for example through the molding-on of locking catches that interact with the fixing device.

Here, the analysis of latching pulses can be used to determine a position even independently of the specific location of the arrangement of the printed circuit board or sensor, particularly of the connection to the connecting device.

Preferably, the printed circuit board or board has a rotationally symmetrical, particularly round, outer contour, the 3D sensor or the first sensor being arranged particularly in an eccentric manner on the printed circuit board.

Also preferably, a mechanical fastening means is provided on the printed circuit board or board in the form of a recess, opening or depression that interacts with a complementary element of the fixing device in order to arrange the board or printed circuit board in a predetermined position on the connecting device or the multi-point socket pin.

This rotational entrainment of the printed circuit board can also be realized independently of the arrangement on or connection to the connecting device.

This arrangement of the printed circuit board or board on the connecting device makes it possible, in particular, for the system to be built modularly, which is to say a different printed circuit board or a corresponding sensor that is adapted to the respective environmental conditions and requirements can be plugged onto the same connecting device or the same handle. For instance, printed circuit boards or boards can be provided that comprise a component for wireless data communication or can be connected thereto, particularly a data communications device arranged in the handle or handle housing. This makes it possible for signals [to be sent] to an external unit such as an alarm center or a house automation system, if such networking is desired.

However, if such external data communication is not desired, another simpler and hence more economical printed circuit board or board can be used which enables, for example, only the forwarding of signals to an alarm device or output device arranged in the handle or handle housing. Examples of such elements arranged in the handle or handle housing are input/output devices such as a keyboard, switch, a loudspeaker, a touch screen or displays that make it possible for the system to be initialized and/or monitored and for alarms and the like to be outputted simultaneously. Particularly, a power supply for the printed circuit board is also arranged in the handle or handle housing, for example in the form of a battery, an accumulator or a solar cell.

In particular, it is preferred that an accumulator be charged via the solar cell or a solar panel that is preferably arranged on a side of the door or window facing away from the system. Due to the connection to the system, particularly to the handle or handle housing, the solar panel can be arranged freely around the window or door.

A mechanoelectrical element can also be provided with the aid of which mechanical kinetic energy, preferably of the handle or an element mechanically connected thereto, is used in order to produce electrical power and charge the accumulator. There is also the possibility of charging the accumulator by means of so-called power harvesting, for example by using a thermoelectrical element that makes it possible to exploit existing temperature differences in order to produce electrical power, for example a temperature difference between an in inner and an outer side, i.e., a side of the door or window facing toward the system and a side facing away from the system.

In an arrangement of the printed circuit board on the connecting device, it is especially preferred if electrical contacting of the printed circuit board is enabled by means of plug contacts to the handle, particularly for connection to elements arranged in the handle, for example to the power supply and the loudspeaker or the display device, or if contacting to elements arranged in the handle housing can be achieved via additional plug contacts or loop contacts on the connecting device.

The printed circuit board can also be connected by means of a conductor strand having a plug that can be received in a complementary plug socket that is arranged in the handle housing or in the handle and enables a connection to the elements arranged therein.

The arrangement of the additional elements such as the loudspeaker or the power storage device in the handle housing instead of the handle offers the advantage that a modular system is achieved in which the handle can be changed out independently of the handle housing and different handles can be freely combined with the same handle housing. The functional scope of the system can also be adapted merely by adapting the handle housing or the components arranged therein.

The arrangement according to the invention of the printed circuit board or board also makes it possible, by virtue of the larger designed space present in the handle housing compared to the handle, to connect the printed circuit board to at least one other printed circuit board which, particularly, can be connected by means of a plug-and-play connection to the first printed circuit board, thus expanding the system with additional functional elements. For example, the printed circuit board or board can have a data communications device for wireless, particularly radio connection of the system to external components such as an alarm center, a house automation center or even an external actuator, such as a roller blind motor or a belt winder.

This enables the greatest possible flexibility and hence adaptability of the system to the environmental conditions or to the parameters to be monitored of the actions to be initiated by the system when commensurate environmental conditions are detected.

Examples of wireless, particularly radio data communication are radio standards such as KNX, WLAN, 433 MHz, 886 MHz, 2.4 GHz, 10886 MHz connections, Z-WAVES, ZIGBEE, or the like and/or data communication using free ISM (Industrial Scientific, Medical) frequency bands such as 433 MHz, 886 MHz and/or 2.4 GHz. Besides the first sensor described above in the form of a 3D sensor, which is to say a sensor that enables [determination of] a spatial position and orientation without the need for additional sensor components, the system can also be expanded by additional (second) sensors that detect the environmental conditions, particularly the at least partial destruction of the door or window, for example glass breakage, but also other environmental parameters such as a temperature, an air humidity or incidence of light. In order to increase the measurement accuracy, additional sensors for detecting the position of the handle or of the window or door can be provided, additional 3D sensors, for example, in order to [perform] a redundant analysis of the measurement signals both to prevent measurement errors and to increase measurement accuracy.

The detection of additional environmental parameters in addition to the detection of the position of the handle and the position of the window or door, for example to detect a temperature, air humidity or incidence of light, makes it possible for alarms or actions to be triggered according to particularly freely programmed parameters, for example in order to prompt a user to close or open a window, to enable ventilation or prevent an excessive drop in temperature or, for example, to actuate a roller blind motor or a belt winder in order to enable closing of roller shutters or of the window.

One especially advantageous aspect of the system is that, besides determining the position of the handle or of the window, the partial destruction of the window or door, such as glass breakage, can be detected solely based on the data of the first sensor. Accordingly, as a result of such a—particularly forceful—destruction of the structure, characteristic movements of the handle or printed circuit board occur even if the printed circuit board is not connected to the connecting device. Particularly in the event of a prying-open of the window, a transfer occurs of the movement signal from the fittings of locking device of the window or a door to the connecting device and hence to the sensor arranged on the printed circuit board, and even as a result of vibrations during glass breakage. The data detected by means of the first sensor make it possible to differentiate whether an at least partial destruction of the structure of the door or window has occurred, as opposed to permitted pulses or a merely "harmless event," i.e., harmless pulses such as bird flying against the window pane, a snow ball or ball striking the window pane or knocking on the window pane with an object. In this way, destruction of the structure, particularly in the event of a burglary, can be clearly recognized. This is based on the surprising insight that an object flying against the window pane generates a single, discrete acceleration or movement pulse. In the case of the partial destruction of the structure of the window or door, for example during a break-in with a crowbar or the destruction of the glass, an acceleration event occurs that extends over a detectably longer time period, particularly by a factor of 4-5, and simultaneously generates other movement signals.

Further investigations have shown that an analysis only of the amplitude value, independently of the length and the curve of the acceleration applied, also leads to very good coverage in terms of the differentiation between alarm events and everyday events. For this reason, it is an option to only evaluate the amplitude values and to draw conclusions from this as to an alarm event. This offers the advantage that the measurement process and the electronic/software analysis is substantially shorter, thus extending the service life of the battery and/or enabling the construction of less-complex and therefore more cost-effective microcontrollers, since the demands placed on the performance and memory requirements are not as high.

The detection of an alarm situation can also be performed independently of the positioning of the printed circuit board, particularly on the connecting device, provided that the corresponding pulses or acceleration signals are forwarded to the sensor.

The monitoring of the length, but also particularly the exact parameters of the event as well, enables the clear detection of the event of the destruction of the structure of the window or door without the need for additional sensors that make, in particular, additional manipulation of the door or window or of a neighboring structure necessary.

The arrangement of the printed circuit board or board on the connecting device, particularly in combination with the latching device, enables a calibration of the system without the need to provide the system with additional input devices. For instance, it is possible for a calibration mode to be initiated by moving the handle in a predetermined manner back and forth between different positions, particularly locking positions, for example two times between the locking and unlocking position. In doing so, both the 180° movement and the locking events upon engagement in the locking and unlocking position as well as the movements through the partial unlocking position are detected via the sensor. Once this calibration mode has been switched on, the individual locking positions of the handle can then be initiated in a predetermined manner and, at the same time, the different positions of the door or window can be set, particularly a completely open position, a completely closed position and a tilted position and combinations of the positions of the handle and window, with a provision being made in particular that, upon reaching the respective window position, the handle is moved in turn in a predetermined manner between various locking positions in order to inform the system that the respective position of the window or door has been reached.

Moreover, the first sensor also enables different pulses to be detected and recognized as inputs of a user. The first sensor can therefore constitute part of an input device by means of which a user can give commands to the system, particularly to bring about an operating state or operating mode, for example the switching-on of the calibration mode. Single or multiple tapping, for example, can be recognized as such inputs, particularly double-tapping comparable to the clicking and double-clicking on a computer mouse. In doing so, the user can tap the handle, the handle housing, the connecting device or other units that are mechanically connected to these components, such as the window or door itself, in order to change the operating mode.

The aforementioned calibration processes can also be achieved by means of this inputting of commands. The user also has the opportunity to switch individual system functions on and off, for example battery monitoring, weather monitoring, the outputting of signals via the output device or set parameters associated therewith. For instance, it is possible to set threshold values for the outputting of a warning due to a low charge in a battery or power storage device, threshold values for the outputting of reports regarding monitoring of the weather, particularly temperature threshold values or humidity threshold values, or different tones. These inputs, particularly in combination with the position of the handle detected via the latching device, can be used to switch different functions and different operating modes of the system. For instance, by means of the incoming pulses, such as double-tapping, an operating mode can be selected to change parameters, and by changing the position of the handle, for example from a 3 o'clock to a 12 o'clock position, parameters can be changed in one direction, and by changing the position of the handle from a 3 o'clock to a 6 o'clock position, they can be changed in another direction.

The fact that these pulses can be differentiated clearly from alarm events is exploited here. In order to avoid an unwanted change in the system operating mode, a provision can particularly be made that the detection of a corresponding pulse, particularly tapping or double-tapping, is mediated by acoustic or optical signals, commensurate signals being emitted particularly when the operational parameters are changed or when functions are switched on and off. This calibration and changing of the operational modes of the system on the basis of latching pulses and/or other pulse types, such as tapping, can also be realized independently of the arrangement of the printed circuit board on the connecting device.

Particularly the calibration, but substantially the basic construction using the 3D sensor, enables the automatic detection of the positions such as those referred to as 12 o'clock, 3/9 o'clock, and 6 o'clock. Installation to the left or to the right of the window is also possible without the need for further adaptation, as is the case with an installation that is rotated by 180°.

In this way, it is particularly achieved, for example, that when the magnetic field is altered by elements arranged in the area of the window or the door, clear recognition of the respective position of the window or door is enabled nonetheless. By means of an appropriate storage device or microprocessor of the system, it is therefore made possible, on the basis of the programming of the microprocessor, to detect various positions, particularly swivel positions of the door or window by means of the first sensor device, and to simultaneously clearly detect the position of the handle by means of the first sensor and thus carry out a calibration of the entire system, particularly for the clear identification of the respective position of the handle or of the window, for example upon initial installation or when the system or the window or the door is modified. At the same time, glass breakage can also be detected through appropriate programming, as explained above.

In particular, this enables an alarm to be triggered when the handle is in a closed position and a horizontal or vertical swinging of the window or door, particularly out of a closed position, is detected. It also enables an alarm to be triggered when the handle is in a partial unlocking position and a movement of the window or door occurs about a swivel axis that is normally not permitted in this partial locking position of the window or a movement of the handle out of the partial locking position into an unlocking position occurs even though the window is not moved from a tilted position into a closed position. This is particularly the case if a hardware part is broken in a tilted position of the window during a burglary. Particularly when using an acceleration sensor, an abnormal force on the frame of the window or door itself can be detected, thus recognizing a break-in attempt. This also makes it possible to activate the system by means of an input device such as a button in order to proactively initiate an alarm monitoring state when the window is in a tilted position.

Moreover, additional signals can be emitted via an output device to indicate an alarm or a malfunction. For example, a circumferential, transparent illuminating ring can be disposed between the handle housing and the handle. When the printed circuit board is arranged in the vicinity of the connecting device, the printed circuit board is therefore also arranged in the vicinity of this illuminating ring. An optical output device arranged on the printed circuit board and therefore connected to the handle or connecting device in an entrainment-secure manner, the circumferential illuminating ring therefore reliably lights up. The illuminating ring and through hole can therefore be used as a signal transmitter for other applications, such as the displaying of a charge state of a power storage device or the outputting of other alarms, for example to warn of a fire if a smoke detector is integrated into the system. For example, a request for a battery change can be outputted through color change signals, particularly by displaying an alternating red/green signal. Furthermore, using a twilight sensor, the illuminating ring can be lit constantly as night falls in order to give a resident a sense of security and to signal the presence of an alarm to a burglar.

What is more, an optical or acoustic output device can also be embodied simultaneously as an input device, for example in the form of a touch screen or piezoelectric loudspeaker, which can then be used simultaneously as a microphone for receiving spoken commands. For example, a spoken command can be used in order to switch an alarm function on and off, or an additional childproofing function can be activated by a spoken command, particularly such that an alarm, preferably an acoustic alarm, is outputted when the position of the handle is altered.

Moreover, the system may comprise a functional unit that is spatially separated from the system and particularly comprises an additional sensor such as a proximity sensor, particularly an infrared proximity sensor and/or a twilight sensor. Additional environmental parameters can then be detected by means of the functional unit.

The use of such a functional unit can also be realized independently of the arrangement of the printed circuit board on the connecting device or the handle.

A connection of the functional unit can be done via cables or wirelessly, or the functional unit can be embodied as a preferably retrofittable plug-and-play functional unit. For example, in the case of a wired connection, if an opening, particularly hole, is provided in the window or door on the side facing sway from the handle housing, then the functional unit can be mounted from the outer side of a window or door frame through the window profile or door profile such that it can be connected to the system, particularly in a pluggable manner.

This makes it possible for the system to receive additional outside information and to add additional functions. For instance, a provision can be made that the functional unit comprises a proximity sensor, and it is detected when people approach the window or door from the outside. The system can then, particularly by means of a device embodied separately from the system, output light or tone signals to the resident or to the approaching person or switch on an interior or exterior light via appropriate radio applications.

Preferably, depending on the distance of the person from the functional unit, different intensities of the signal are selected; particularly, different light intensity levels are switched on via the system. For instance, a slight flickering of the light can be produced at a great distance, and a stronger light signal can be outputted at a shorter distance, particularly combined with the outputting of signals via the output and input device comprised by the system, such as the illuminating ring described above, which can particularly be switched parallel to tone signals.

When using a twilight sensor in the functional unit, additional possible applications can be achieved, such as the controlling of an additional device embodied separately from the system such as a roller blind motor for lowering the roller blinds or for switching on interior or exterior lighting.

In order to achieve climate control of an interior space, the values provided via the functional unit or the sensor present in the system, for example temperature or humidity values, can be used to control a heating system, particularly a space heater. In this way, an appropriate heating profile can be executed, or sufficient ventilation of a room sealed off by the window or door can be achieved via an electromechanical ventilation system, which can be embodied as a device or functional unit separate from the system.

An appropriate ventilation system can also be implemented in the system itself, for example by means of an underpressure valve that establishes a connection to the outside of the window or door.

For instance, when operating a fireplace, care must be taken that sufficient ventilation of the space is ensured and that a constant air supply is provided when operating an extractor hood. Through the integration of an appropriate valve mechanism, particularly of an integrated underpressure valve, the fireplace or extractor hood can be operated without the need on the part of the user to take additional actions to achieve sufficient ventilation. A carbon monoxide sensor can also be used as a second sensor used in the functional unit or in the system itself which, for example when a fireplace is being operated, then controls the carbon monoxide content and performs ventilation proactively through the valve mechanism or by means of a ventilation device embodied separately from the system as described previously, and/or it simultaneously outputs an alarm through the output device.

Such a ventilation mechanism can also be realized independently of the arrangement of the printed circuit board on the connecting device or handle.

As an additional security function, the system enables, for example by recording temperature values, the detection of a fire in the interior space and thus the triggering of an alarm or forwarding a commensurate signal to a house automation center. When an excessive concentration of smoke or carbon monoxide is detected, or when there is excessive heat or underpressure, the system can also trigger other actions can besides the generation of an alarm; for example, interior or exterior lighting can be switched on and off, roller blinds can be raised, and the like.

The system can also be connectable to a device embodied separately from the system which can be embodied in the form of a drive mechanism, such as an integrated worm gear. This drive mechanism makes it possible, for example, to change the position of the handle, i.e., to move the system from a locking to an unlocking or partially unlocking position and subsequently open and close the door or window, it being possible for this opening and closing of a window to occur in response to one or more of the previously described environmental situations, particularly depending on the quantity of recorded measured values, for example the concentration level of harmful gases or the strength of underpressure prevailing in the interior space. This activation of the drive mechanism can also be realized independently of the arrangement of the printed circuit board on the connecting device and/or the handle.

On the basis of the connections described above of the system to the functional unit or a device embodied separately from the system, additional functions can be implemented. For instance, in public buildings both in the private sector and in office complexes, the demand for emergency light and indicators for states of emergency is substantial. If a corresponding emergency situation is detected, the system makes it possible to forward this information by communicating with the device, particularly transferring it to every room in the building and outputting the appropriate information. In that case, both the system itself and the output device can be used to convey such information. In particular, a plurality of systems according to the invention can be networked together, particularly independently of a centralized house automation center. The systems are networked according to the master-slave principle, for example.

Moreover, the system enables the implementation of a presence detector or positioning detector. Accordingly, the input device can be provided as an appropriate reading device, for example for personal identification, that makes it possible to log in and out for a visit or for work. For instance, cleaning crews or craftspeople, such as window washers, can log in via the system when they begin their work, and this recorded personal identification is forwarded to the device, particularly a data center, so that the exact working hours and work can be checked.

This networking of a plurality of systems and personal identification can also be realized independently of the arrangement of the printed circuit board on the connecting device or the handle.

Moreover, a photographic camera can also be provided as an input device which, particularly in various emergency and alarm situations or in the case of a signal received via the data communications device, enables monitoring of the interior space in addition to the storing or transmission of the recorded visual data. It is possible in this way to monitor the space remotely using the system. Such monitoring of spaces can also be realized independently of the arrangement of the printed circuit board on the connecting device.

Overall, the system makes it possible, in an energy-saving manner, to control appliances within a building. For instance, through light measurement and presence detection by means of various sensors, for example a motion detector, a temperature detector or a moisture sensor, the light, which is to say the interior lighting, can be controlled fully automatically, thus minimizing energy consumption. Energy savings are also achieved due to the fact that appropriate signals can be sent via the system to a heating and climate control unit, particularly ventilation control, thus enabling energy-optimized regulation of the climate in the space.

The functional components described above, particularly the sensors of the system according to the invention, further enable the implementation of living-home concepts. In order to cope with the increasing age of the population, one aim is to configure domestic life as comfortably as possible and to preserve the residents' independence as long as possible through many auxiliary devices.

The system according to the invention makes it possible, for example via integration motion sensors, to place a wireless mesh network into the space and, on the basis of learning profiles, learn the gait, upright walking and, even in a self-learning manner, the position of various pieces of furniture, of a sofa, for example, and thus include in the assessment whether the resident is walking, sitting and lying like always, which is to say as they do when they in healthy condition, or whether the person's behavior is changing as a result of aging or an illness. For example, the dwindling of various vital functions could even be detected upon actuation of the handle, thus obtaining additional information about their condition in order to forward an alarm signal to an emergency or nursing service to request support for the person.

In a childproofing mode that can be activated and deactivated via an appropriate input device, it is also conceivable for an alarm to be triggered when the window is in a closed position and the handle is moved from a locking position into another position. It is possible to switch between different system modes using the input device, but also by passing through predetermined positions of the system and/or of the window and/or of the door.

A calibration as described above can also be done by means of appropriate input devices, for example a button on the evaluation circuit, that indicate when the window is in a predetermined position provided for calibration.

Additional features and advantages follow from the description below, in which preferred embodiments of the invention are explained with reference to schematic drawings.

Figure 1:
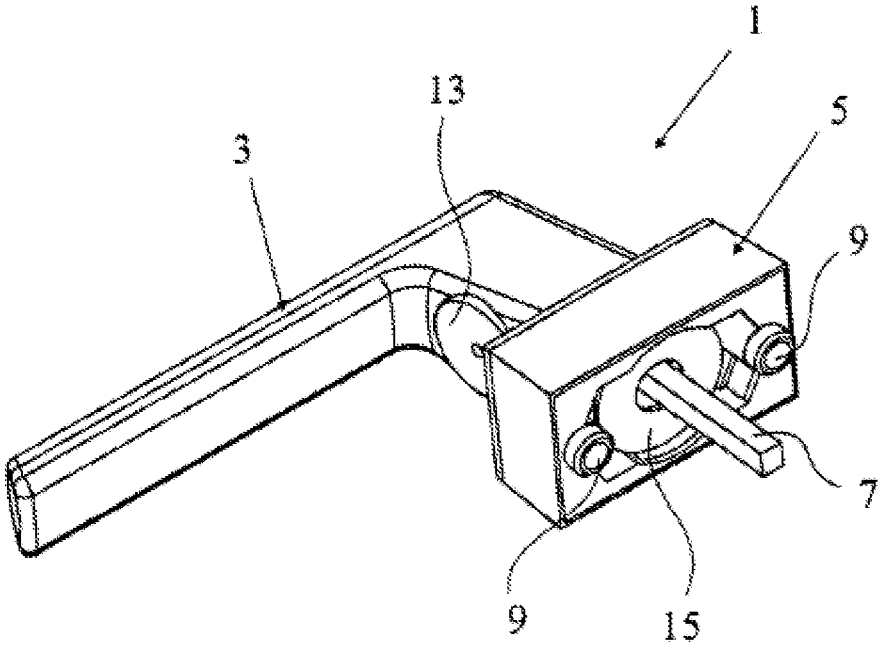
FIG. 1 shows a perspective top view of a first embodiment of a system according to the invention.

FIG. 1 shows a top view of a system 1 according to the invention. As follows from FIG. 1, the system 1 is embodied in the form of a window handle and comprises a hand or grip part in the form of a handle 3. The handle 3 is hinge-mounted relative to a handle housing 5, a connecting device in the form of a square socket pin 7 being connected in a rotationally secure manner to the handle 3 which protrudes through the handle housing 5.

The handle housing 5 comprises holes 9 by means of which the system, particularly the handle housing 5, can be fixed to a window frame (not shown).

The system 1 comprises a monitoring system by means of which the locking state of a window that can be actuated via the system 1, as well as the position of the system 1, particularly of the handle 3, can be monitored. This monitoring system is used to generate alarms in various operational states of the system 1 or of a window on which the system 1 is mounted. For this purpose, the handle 3 has a recess 11 in which an output device is arranged in the form of a loudspeaker 13. The loudspeaker 13 is electrically connected to a printed circuit board 15 via a cable connection not shown in FIG. 1. As will be explained further below, the printed circuit board 15 or a first sensor arranged on the printed circuit board 15 makes it possible to monitor both the state of movement and the position of the system 1, particularly of the handle 3 and of the window on which the system 1 is arranged.

In alternative embodiments, a provision can also be made that the loudspeaker 13 is arranged in the handle housing 5.

It can be seen particularly in FIG. 1 that the printed circuit board 15 is arranged in a radially symmetrical manner around the square socket pin 7 within the handle housing 5, particularly in a rotationally secure manner, as will be explained later.

Figure 2:
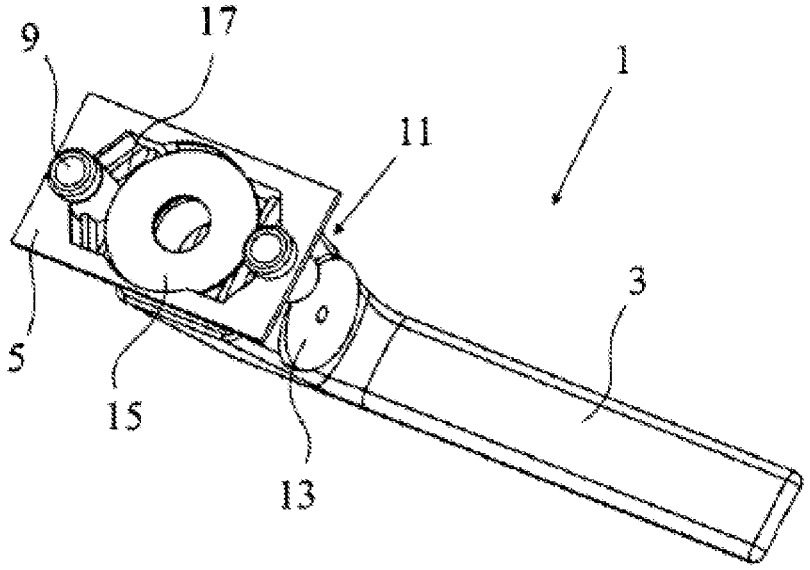
FIG. 2 shows a top view of the lower side of the system according to 1.

FIG. 2 shows a view of the lower side of the system according to FIG. 1. However, FIG. 2 does not show a covering hood of the handle housing 5 so that it can be clearly seen that the handle housing 5 is manufactured using an injection molding process and comprises a first part of a latching device 17, which will be explained later.

Figure 3:
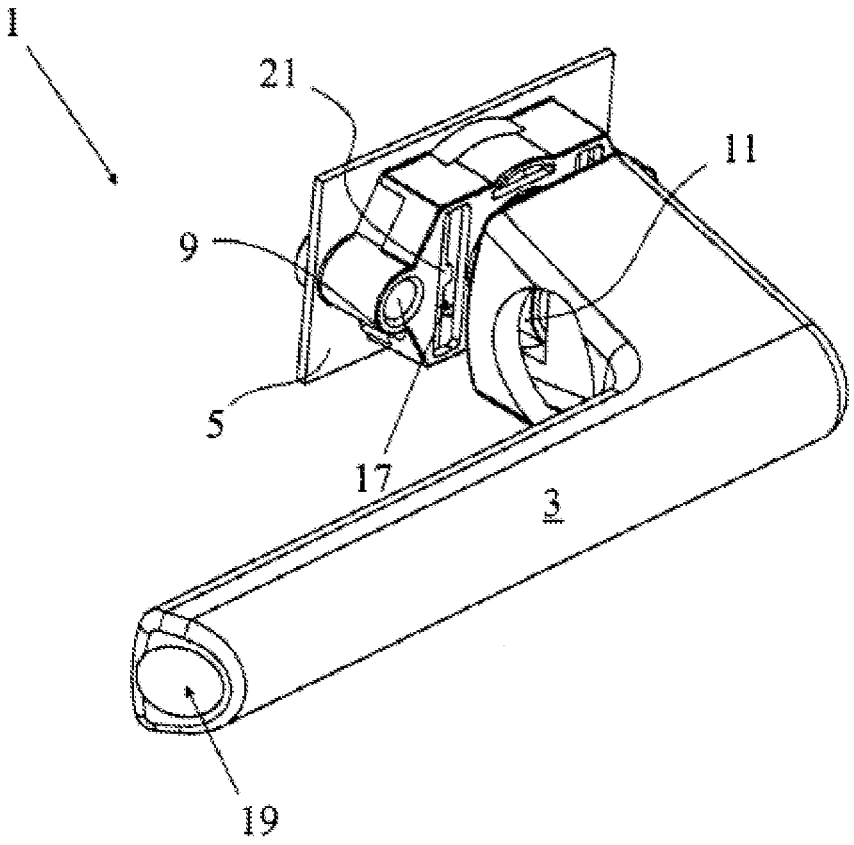
FIG. 3 shows a top view of the upper side of the system according to FIG. 1 (without covering hood of the handle housing)

FIG. 3 shows a top view of the system 1 according to FIGS. 1 and 2. As follows first from FIG. 3, a recess 19 is further provided in the handle 3 in which an energy store, particularly a battery or an accumulator for supplying the monitoring system with power, particularly the printed circuit board 15 and the loudspeaker 13, 15 arranged in the recess 11, can be arranged. Alternatively, this energy store can also be arranged in the handle housing 5, particularly in a recess arranged there, instead of in the handle 3. Particularly, the recess 19 can be sealed by means of a covering such that a smooth closure of the lower edge of the handle 3 or of the handle housing 5 is achieved. FIG. 3 also shows details of the latching device 17. Accordingly, the handle housing 5 particularly comprises a locking catch 21 of the latching device 17.

This locking catch 21 engages in predetermined positions of the handle 3 relative to the handle housing 5 with another element of the latching device connected to the handle 3 or the square socket pin. The handle housing 5 is particularly an injection-molded part, and the latching device, particularly the part of the latching device that is embodied on the housing 5, is embodied in a single piece with the handle housing 5.

Figure 4:
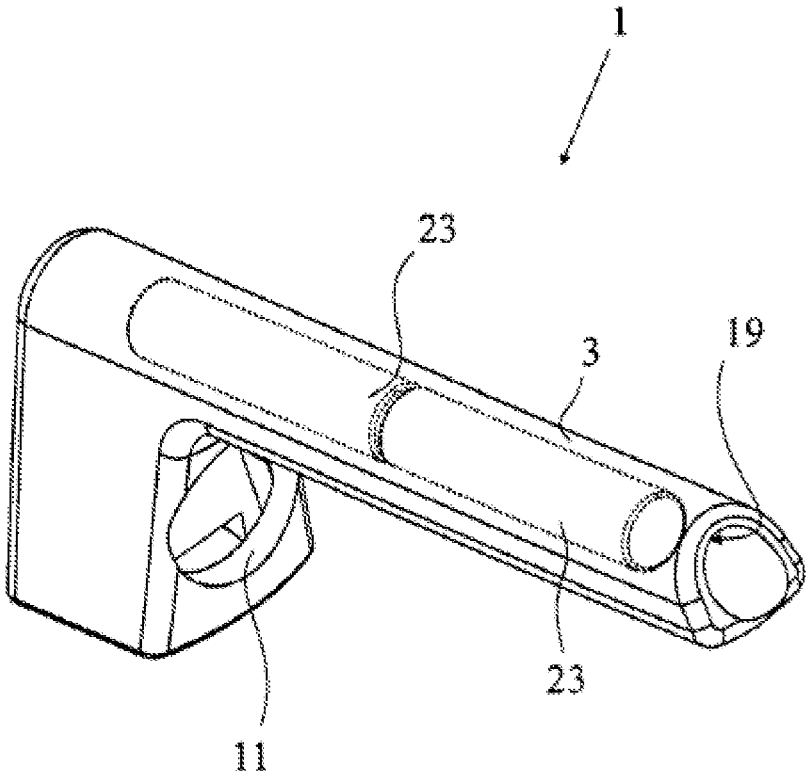
FIG. 4 shows a wire frame model of the system according to FIG. 1.

FIG. 4 shows a wire frame model of the system 1. In particular, it is visible in FIG. 4 how energy stores are arranged in the form of batteries 23 within the recess 19, which is embodied in the handle 3.

Figure 5:
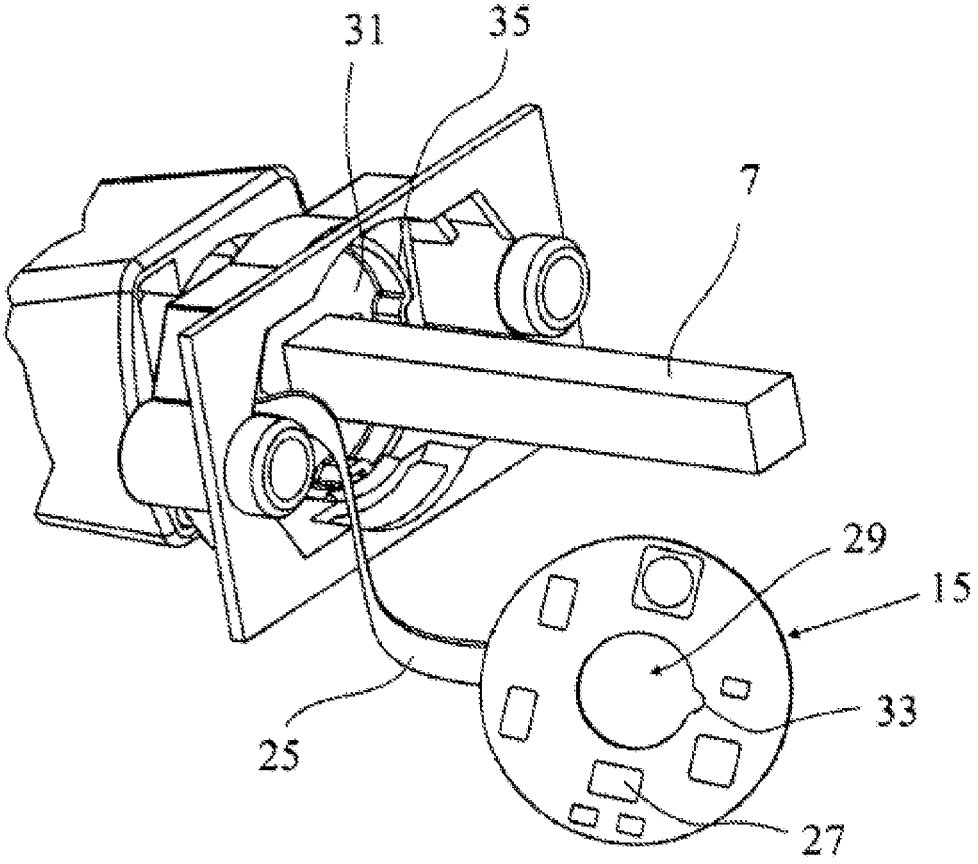
FIG. 5 shows a top view of a printed circuit board of a system according to FIG. 1.

FIG. 5 shows a top view of the printed circuit board 15 and makes visible, in particular, the wired connection 25 of the printed circuit board 15 to the elements arranged in the handle 3, particularly in the form of batteries 23 and of the loudspeaker 13. Arranged on the printed circuit board 15 is, in particular, a first sensor in the form of a 3D sensor, more precisely a sensor of type HNC 5843 of the Honeywell Company or of type ADXL345 of the Analog Devices Company. The sensor 27 enables the determination of the exact spatial position and orientation of the sensor and hence of the printed circuit board 15 on the basis of the Earth's magnetic field lines. A 3D acceleration sensor can also be used to enable this positional detection. For this purpose, the acceleration values are combined with time information in order thus determine the respective spatial position. As also follows from FIG. 5, the printed circuit board 15 has a substantially rotationally symmetrical, particularly circular outer contour. An opening 29 is embodied in the middle of the printed circuit board 15 that makes it possible to place the printed circuit board 15 onto the square socket pin 7.

Arranged for this purpose on the square socket pin 7 is a fixing device 31, which will be explained in further detail below. The fixing device 31 has on its outer contour a catch that is arranged so as to engage with a recess 33 of the printed circuit board 15, which is arranged in the opening 29. As a result, it is possible for the printed circuit board 15 and hence the sensor 27 arranged eccentrically on the printed circuit board 15 to be arranged in a predetermined relative position to the square socket pin 7 and the handle housing 5.

Figure 6:
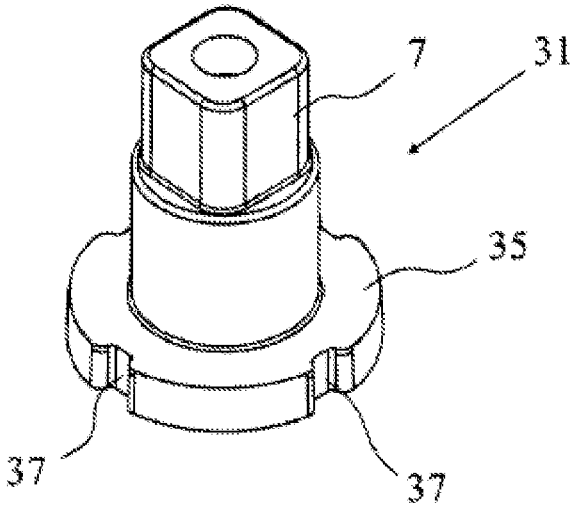
FIG. 6 shows a top view of a fixing device of the system according to FIG. 1 plugged onto a connecting device.

FIG. 6 shows more detail of the fixing device 31 placed on the square socket pin 7. The fixing device 31 has a section 35 against which the printed circuit board 15 lies with its rear side (FIG. 5). Moreover, additional elements of the latching device 17 are arranged on the fixing device 31, particularly recesses 37 that engage, in predetermined positions of the fixing device 31 relative to the handle housing 5 and hence the printed circuit board 15 and the sensor 27 to the handle housing, with the locking catches 21 that are arranged in a pretensioned manner on the handle housing 5. Due to the rotationally secure connection of the fixing device 31 on the square socket pin 7, three positions of the square socket pin 7 are particularly able to engage, particularly a locking position in which a window locking device actuated via the square socket pin 7 brings about a locking of the window on a frame, an unlocking position in which the locking of the window to a frame is undone, preferably at least in part, particularly in order to enable swiveling of the window about a vertical axis from a closed to an open position, and a partial unlocking position or a position in which the window is unlocked, preferably at least in part, such that a—particularly limited—rotation or tilting of the window about a horizontal axis from a closed position into a tilted position is enabled. Additional latching positions are conceivable.

The arrangement of the printed circuit board 15, and hence of the sensor 27 on the fixing device forming a part of the latching device 17, offers the advantage that a best-possible transfer of the pulses originating from the latching device 17 to the sensor 27 is achieved.

As will readily be understood, when using the system 1 on a sliding door or a sliding window, different positions of the square socket pin are lockable, for example an unlocking position in which the sliding window can be moved from a closed and an open position.

Figure 7:
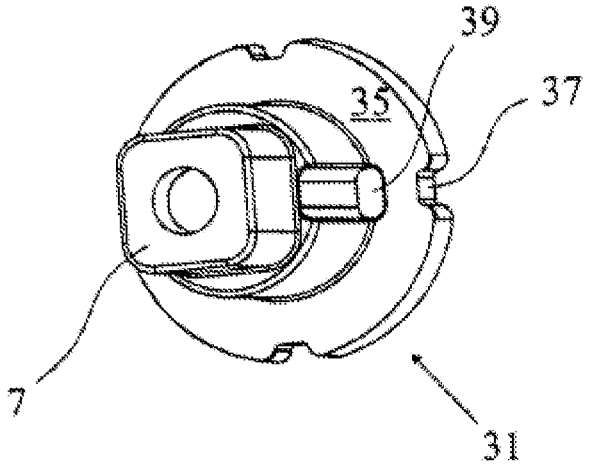
FIG. 7 shows a top view of the fixing device according to FIG. 6 from another perspective.

FIG. 7 shows a different top view of the square socket pin 7 and the fixing device 31. As also follows from FIG. 7, the fixing device 31 has a catch 39 that engages with the recess 33 of the printed circuit board 9 and connects it in a rotationally secure manner.

Figure 8:
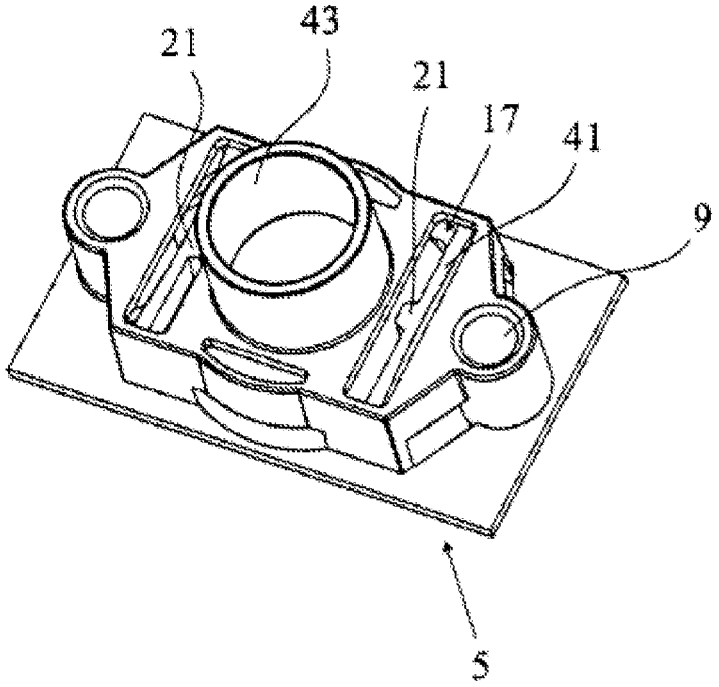
FIG. 8 shows a top view of the handle housing of the system according to FIG. 1 comprising a portion of the latching device (without covering hood).

Finally, FIG. 8 shows a top view of the handle housing 5. As also follows from FIG. 8, the locking catch 21 is mounted in a pretensioned manner via a spring element 41 of the latching device 17. The through hole 43 for the square socket pin (not shown in FIG. 8) is also visible in FIG. 8. It also follows from FIG. 8 that the latching device 2 has locking catches 21 that are disposed diametrically with respect to each other. This makes it possible, in particular, to establish two latching positions of the square socket pin or of the fixing device.

The features described or listed in the application documents, particularly in the figures, the claims and the specification can be essential for the implementation of the invention in various embodiments both individually and in any combination.

The invention claimed is:

1. A system for changing a locking state of a closure member, the closure member being a window or a door and being movably mounted to a structure, the system comprising:

a handle housing that is adapted to be coupled in a rotationally secure manner to the closure member;

a handle that is rotatably mounted relative to the handle housing, the handle being non-rotatably coupled to a connecting device extending through the handle housing by means of which the locking state of the closure member is selectively changeable; and an electronic evaluation circuit that is configured to detect the position of the handle, the evaluation circuit having a printed circuit board arranged at least partially within at least one of the handle housing and the handle, the printed circuit board comprising a first sensor;

wherein the printed circuit board is non-rotatably coupled to at least one of the connecting device and the handle;

wherein the printed circuit board has an opening for receiving the connecting device such that the printed circuit board is non-rotatably coupled to the connection device; and wherein the first sensor comprises at least one sensing device enabling autarchically the determination of its own spatial position and/or its orientation, and/or at least one sensing element of the first sensor and/or of the sensing device is positioned eccentrically on the printed circuit board relative to an axis of rotation of the printed circuit board, the connecting device and the handle.

2. The system as set forth in claim 1, wherein the handle housing comprises a handle fitting and/or the handle housing is formed by a handle fitting, wherein the handle fitting is configured to be attached to the closure member.

3. The system as set forth in claim 1, wherein the connecting device comprises a multi-point socket pin and/or the connecting device is operatively engagable with at least one locking device of the closure member by means of which the position of at least one fitting element of the closure member is selectively changeable.

4. The system as set forth in claim 1, wherein at least one latching device is arranged within the handle housing and/or adjacent to the printed circuit board, wherein the latching device has locking catches and/or a spring-loaded ball mechanism enclosed at least partially within the handle housing and/or embodied with the handle housing, by means of which latching device the handle and/or the connecting device is engagable in at least one or in a plurality of handle positions.

5. The system as set forth in claim 1, further comprising a latching device and a fixing device, the latching device being arranged within the handle housing, the fixing device being at least partially enclosed by the latching device, which is non-rotatably coupled to the handle, wherein the printed circuit board is non-rotatably coupled to the fixing device.

6. The system as set forth in claim 1, wherein the printed circuit board has a rotationally symmetrical, circumferential shape and/or at least one receptacle, is provided at the printed circuit board, in the vicinity of at least one opening for receiving the connecting device and/or the fixing device and/or in the surface of the printed circuit board, wherein the at least one receptacle being configured to engage with at least one complementary element arranged on a surface of the connecting device and/or the fixing device, or the printed circuit board comprises the complementary element and the connecting device, the handle and/or the fixing device comprises the receptacle.

7. The system as set forth in claim 6, wherein the sensing device enables the determination of the position and/or orientation based on acceleration data, velocity data, movement data, Earth's magnetic field data, GPS data and/or (gyro) compass data, wherein the sensing device comprises at least one 3D sensor, wherein the at least one 3D sensor comprises a 3D-MEMS acceleration sensor.

8. The system as set forth in claim 6, wherein the sensing device enables the determination of the handle position, the open position, the closed position and/or the tilted position of the closure member, of an at least partial destruction of the structure of the closure member, and/or of the position of the printed circuit board, the fixing device, the connecting device and/or handle.

9. The system as set forth in claim 1, wherein at least one component that is connectable electrically, electronically, by cable and/or wirelessly to the printed circuit board and/or arranged on the printed circuit board, said component comprising at least one power source an optical and/or acoustical output device, at least one input device, a reading device, a data communications device, at least one additional printed circuit board that can be stacked on the printed circuit board, a valve assembly, and/or a functional unit spatially separated from the system and connected to the system by cable, wirelessly and/or by radio, wherein said component being arranged at least partially in the handle, the connecting device, the fixing device, the latching device and/or the handle housing, the additional printed circuit board comprising the data communications device, the data communications device operating on free ISM frequency bands, and/or the additional printed circuit board is mounted in a stationary manner relative to the handle housing, the handle and/or the connecting device.

10. The system as set forth in claim 9, wherein the power source comprises an energy store and wherein a signal is output by means of the output device when the charge of the energy store device undershoots a predetermined threshold value and/or a hole in the handle housing and/or the handle is selectively illuminated by means of an optical output device that is coupled to the printed circuit board.

11. The system as set forth in claim 9, wherein an output signal intensity of the output device is controlled based on a predetermined set of environmental parameters.

12. The system as set forth in claim 9, wherein the input device and the output device are embodied at least partially as one device and/or the input device comprises at least in part the first sensor, wherein a one-time or repeated tapping is identifiable by means of the first sensor.

13. The system as set forth in claim 1, wherein at least one connection means by means of which the printed circuit board can be connected to at least one other element, wherein the connection means being enclosed at least partially by the connecting device and/or fixing device, and/or the printed circuit board can be connected automatically to the other element by means of the connection means by plugging onto and/or connecting to the connecting device and/or fixing device.

14. The system as set forth in claim 9, wherein the printed circuit board, the element, the component, the functional unit and/or the other printed circuit board comprise at least one second sensor, the second sensor being at least in part enclosed by the input device.

15. The system as set forth in claim 9, wherein the system is connectable to at least one additional device by means of the data communications device.

16. The system as set forth in claim 14, further comprising at least one calibration device by means of which the data of the first sensor and/or of the second sensor can be calibrated.

17. The system as set forth in claim 1, wherein a plurality of first sensors and/or second sensors is provided.

18. A closure member assembly comprising:

a closure member that is adapted to be movably mounted to a structure, the closure member being a window and/or a door; and a system for changing a locking state of a closure member, the system comprising a handle housing, a handle and an electronic evaluation circuit, the handle housing being non-rotatably coupled to the closure member, the handle being rotatably mounted relative to the handle housing and non-rotatably connected to at least one connecting device extending through the handle housing by means of which the locking state of the closure member is selectively changeable, the electronic evaluation circuit being configured to detect the position of the handle and having a printed circuit board arranged at least partially within at least one of the handle housing and the handle, the printed circuit board comprising a first sensor, the printed circuit board being non-rotatably connected to at least one of the connecting device and the handle;

wherein the printed circuit board has an opening for receiving the connecting device such that the printed circuit board is connected to the connection device in a rotationally secure manner; and wherein the first sensor comprises at least one sensing device enabling autarchically the determination of its own spatial position and/or its orientation, and/or at least one sensing element of the first sensor and/or of the sensing device is positioned eccentrically on the printed circuit board relative to an axis of rotation of the printed circuit board, the connecting device and the handle.

19. A method for detecting a position of a system for changing the locking state of a closure member and of a position of the closure member, the closure member being a window and/or a door that is movably mounted to a structure, the method comprising:

providing the system, the system comprising a handle housing, a handle and an electronic evaluation circuit, the handle housing being non-rotatably coupled to the closure member, the handle being rotatably mounted relative to the handle housing and non-rotatably connected to at least one connecting device extending through the handle housing by means of which the locking state of the closure member is selectively changeable, the electronic evaluation circuit being configured to detect the position of the handle, the evaluation circuit having at least one printed circuit board arranged at least partially within at least one of the handle housing and the handle, the printed circuit board comprising a first sensor, the printed circuit board being non-rotatably connected to at least one of the connecting device and the handle, the printed circuit board has an opening for receiving the connecting device such that the printed circuit board is non-rotatable connected to the connection device, and the first sensor comprises at least one sensing device enabling autarchically the determination of its own spatial position and/or its orientation, and/or at least one sensing element of the first sensor and/or of the sensing device is positioned eccentrically on the printed circuit board relative to an axis of rotation of the printed circuit board, the connecting device and the handle; and determining the locking state and the position by means of at least one first sensor.

20. The method as set forth in claim 19, wherein by means of a calibration device and/or an initialization device, at least one locking state and/or one position is or are allocated to the data detected by means of the sensor.

21. The method as set forth in claim 19, further comprising determining an event entailing at least partial destruction of the structure of the closure member based at least partly on an output signal of a first sensor.

22. The method as set forth in claim 19, wherein an initialization/calibration is initiated by the calibration device and/or the initialization device and/or the changing of an operational state of the system based on data of the first sensor, based on data of at least one second sensor, based on at least one input by means of an input device and/or the generation of at least one pulse acting on the first sensor and/or the second sensor.

23. The method as set forth in claim 19, wherein in order to generate the at least one pulse or a predetermined sequence of pulses, a handle, a connecting device, a fixing device and/or a printed circuit board on which the first sensor is arranged, the system and/or the window and/or the door is moved or transferred to at least one predetermined position.

24. The method as set forth in claim 19, wherein to execute and/or end the calibration and/or initialization, the system and/or the closure member is or are moved into at least one or a plurality of positions.

25. The method as set forth in claim 19, wherein by means of the first sensor, a spatial position and/or orientation of the printed circuit board, a fixing device and/or a connecting device, and/or an action of force on the system and/or the closure member is determined.

26. The method as set forth in claim 19, wherein by means of the first sensor, a swiveling, sliding and/or tilting movement of the closure member is detected.

27. The method as set forth in claim 19, wherein by means of at least one output device, at least one alarm signal is outputted when a prying, swiveling, sliding and/or tilting movement is detected when the system is in a locking position, when a swiveling and/or sliding movement is detected when the system is in a partial unlocking position, when a movement characteristic of an at least partial destruction of the structure of the closure member is detected by means of the first sensor, when the system is in a locking position and the system is in an inward opening prevention position, optionally when the closure member are simultaneously in the closed position and the system is moved out of the locking position.

28. The method as set forth in claim 19, wherein based on data of at least one second sensor, at least one additional environmental condition, the approach of a person, a concentration of at least one gas, a smoke concentration, an intactness of the structure of the window and/or door, a charge state of an energy store device and/or glass breakage is detected by means of the first sensor and/or the second sensor, at least one special alarm is triggered, space monitoring is activated, and/or an additional functional component is controlled.

29. The method as set forth in claim 19, wherein the system is connected to at least one additional device.

* * * * *